US008136247B2

(12) United States Patent
Foote

(10) Patent No.: US 8,136,247 B2
(45) Date of Patent: Mar. 20, 2012

(54) METHOD OF FORMING A BLOWOUT PREVENTER BODY

(75) Inventor: Dean Foote, Edmonton (CA)

(73) Assignee: Darwell Industries Ltd., Edmonton (CA)

( * ) Notice: Subject to any disclaimer, the term of this patent is extended or adjusted under 35 U.S.C. 154(b) by 860 days.

(21) Appl. No.: 12/200,834

(22) Filed: Aug. 28, 2008

(65) Prior Publication Data

US 2009/0056132 A1 Mar. 5, 2009

(30) Foreign Application Priority Data

Aug. 28, 2007 (CA) ..... 2599402

(51) Int. Cl.
*B23P 17/00* (2006.01)

(52) U.S. Cl. ..... 29/890.131; 251/1.1; 251/266; 277/325

(58) Field of Classification Search ..... 251/1.1–1.3, 251/266; 277/325; 29/890.131
See application file for complete search history.

(56) References Cited

U.S. PATENT DOCUMENTS 1,709,949 A * 4/1929 Rasmussen et al. ..... 166/86.2
1,927,190 A * 9/1933 Stephens ..... 166/89.3
2,065,035 A * 12/1936 Taylor ..... 251/329
2,162,018 A * 6/1939 Inge ..... 251/1.3
2,345,815 A * 4/1944 Harroun ..... 166/86.2
2,904,306 A * 9/1959 Bryant ..... 251/367
3,204,929 A * 9/1965 Bryant ..... 251/329
3,554,480 A * 1/1971 Rowe ..... 251/1.3
4,260,134 A * 4/1981 Ripert ..... 251/367
4,373,242 A * 2/1983 Goldman ..... 29/890.122
4,522,432 A * 6/1985 Press ..... 285/55
4,638,972 A 1/1987 Jones
4,844,406 A * 7/1989 Wilson ..... 251/1.3
4,972,577 A * 11/1990 Dierikx ..... 29/890.09
5,044,602 A * 9/1991 Heinonen ..... 251/1.1
5,285,951 A * 2/1994 Dierikx et al. ..... 228/214
5,897,094 A * 4/1999 Brugman et al. ..... 251/1.3

* cited by examiner

*Primary Examiner* — David Bryant
*Assistant Examiner* — Jacob Cigna
(74) *Attorney, Agent, or Firm* — Christensen O'Connor Johnson Kindness PLLC

(57) ABSTRACT

A method of manufacturing a blowout preventer body includes the steps of: providing more than one billet; forming a first billet to form a first portion of the blowout preventer body; forming a second billet to form a second portion of the blowout preventer body; and welding the billets to form the blowout preventer body.

12 Claims, 14 Drawing Sheets

METHOD OF FORMING A BLOWOUT PREVENTER BODY

FIELD

The present application relates to a method of forming a blowout preventer body using forging techniques.

BACKGROUND

Many of the ram-type blowout preventers developed over the past 60 to 80 years utilize rectangular shaped ram blocks that travel in a horizontal direction from opposite sides of the blowout preventer to meet approximately in the middle of a wellbore. The rectangular shape, with square or semi-circular sides, has provided a means to keep the height and weight of the ram blocks reasonable as compared to a circular shaped block. In order to form the gates for the rectangular ram blocks, sand casting is commonly used to manufacture the blowout preventer bodies.

SUMMARY

There is provided a method of manufacturing a blowout preventer body. The method comprises the steps of: providing more than one billet; forging a first billet to form a first portion of the blowout preventer body; forging a second billet to form a second portion of the blowout preventer body; and welding the billets to form the blowout preventer body.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
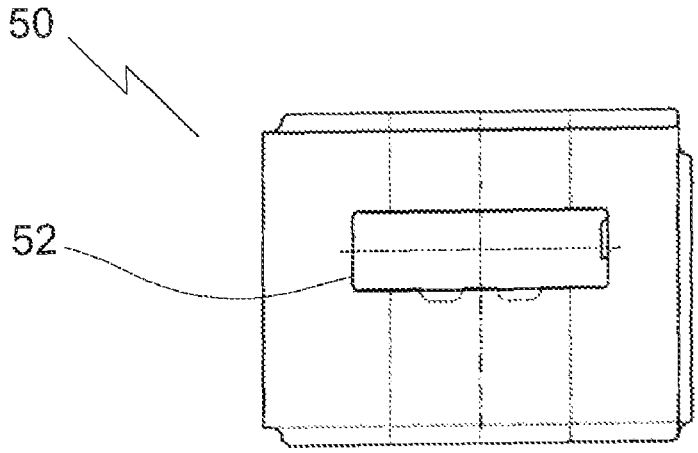
FIG. 1 (PRIOR ART)
FIG. 1 labelled as PRIOR ART is an end elevation view of a prior art casted single gate blowout preventer.
Figure 2:
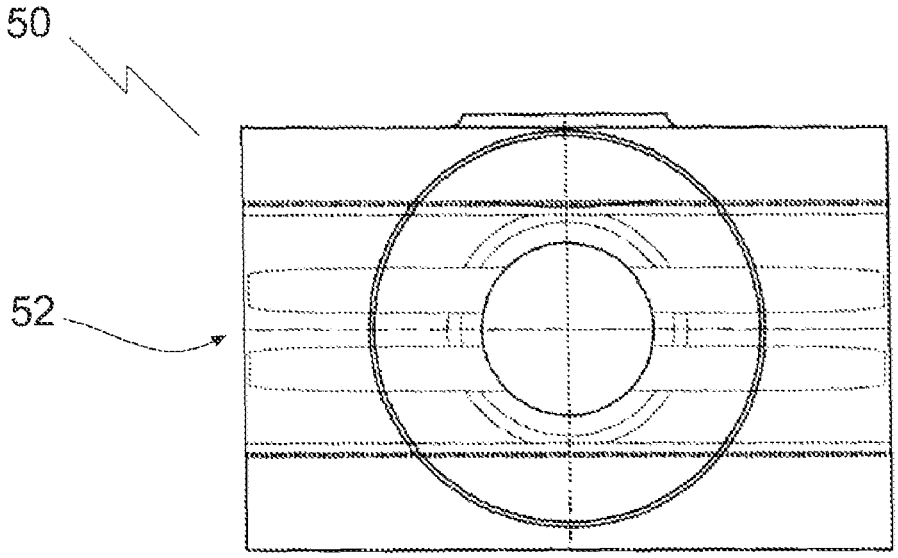
FIG. 2 (PRIOR ART)
FIG. 2 labelled as PRIOR ART is a top elevation view, in section, of the blowout preventer of FIG. 1.
Figure 4:
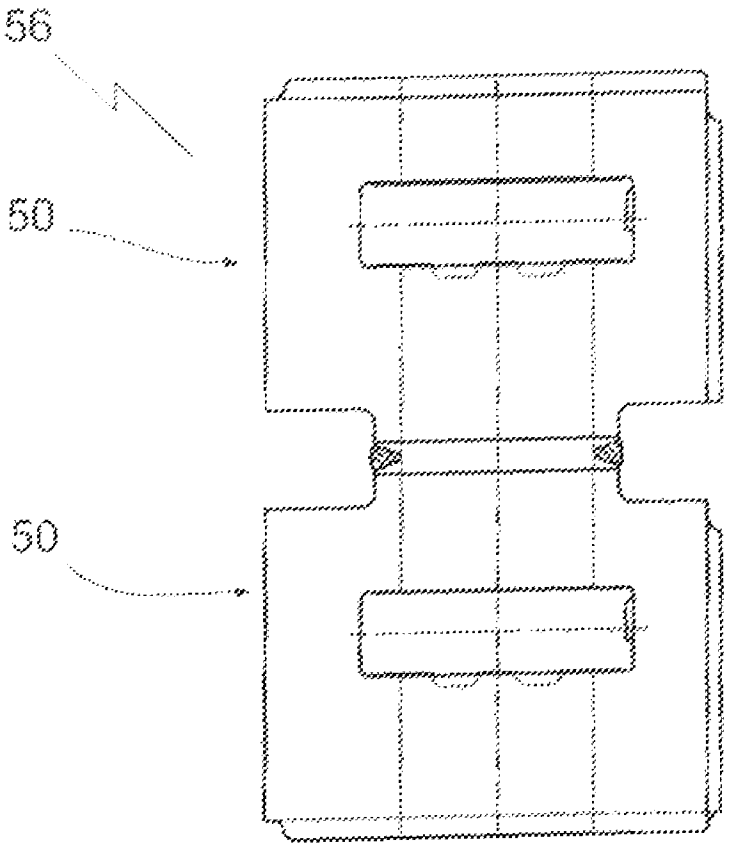
FIG. 4 (PRIOR ART)
FIG. 4 labelled as PRIOR ART is an end elevation view of a pair of prior art casted single gate blowout preventers welded together.
Figure 3:
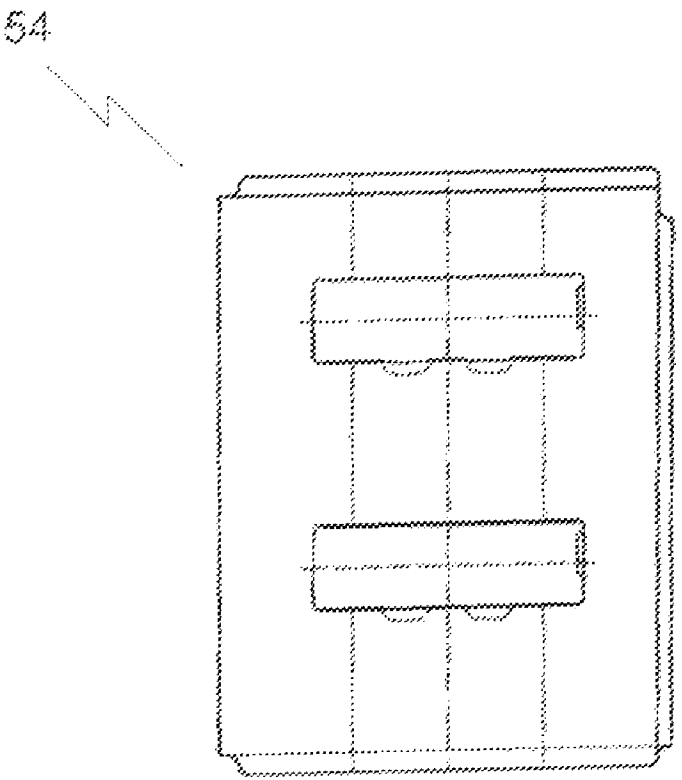
FIG. 3 (PRIOR ART)
FIG. 3 labelled as PRIOR ART is an end elevation view of a prior art casted double gate blowout preventer.

A blowout preventer body considered to be Prior Art is illustrated in FIG. 1 through FIG. 4. Referring to FIGS. 1-2, a typical blowout preventer body 50 is shown. Blowout preventer body 50 has a rectangular ram block opening 52. Body 50 is constructed by casting steel around a sand core. FIGS. 1-2 show a single gated embodiment of blowout preventer body 50. Referring to FIG. 3, a double gated embodiment blowout preventer 54 is shown. Referring to FIG. 4, a blowout preventer body 56 that is an embodiment of the prior art is shown. Blowout preventer body 56 includes two single gated blowout preventer bodies 50 welded together. The one piece casting methods used to manufacture any of blowout preventer bodies 50 from FIGS. 1-4 are generally expensive and often lead to imperfections that effect the usefulness and safety of blowout preventer bodies 50, 54, and 56. The cast steel method also has practical limitations as to the number of gates that can be formed from one body due to the weight and complexity of the sand core required to form each rectangular internal profile.

A blowout preventer body generally identified by reference numeral 70, will now be described with reference to FIG. 5 through 37.

Figure 27:
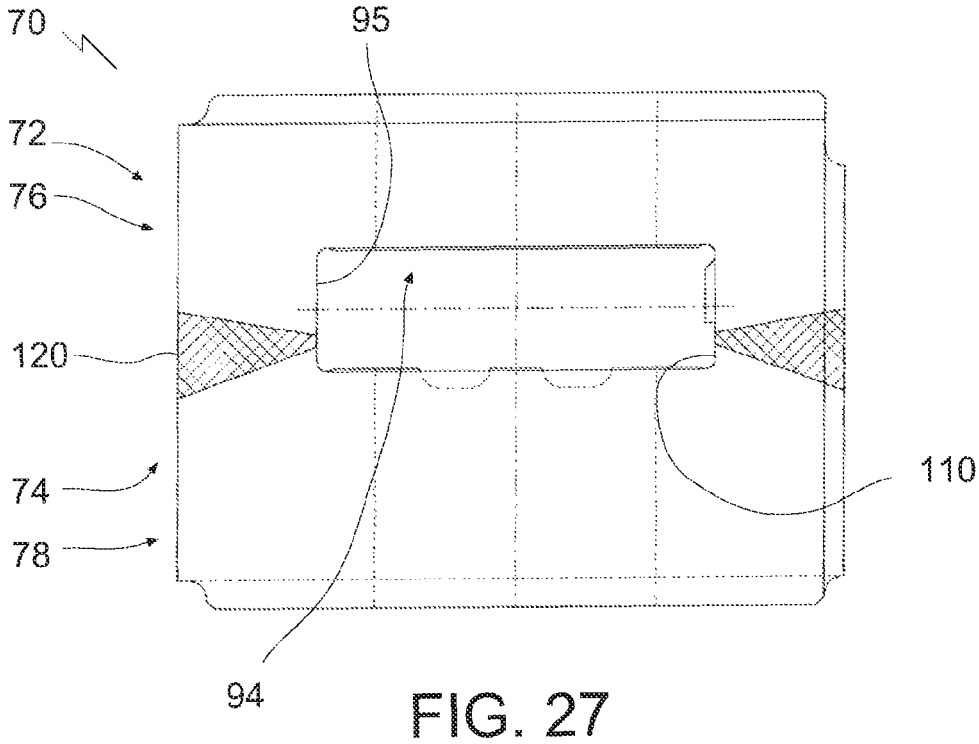
FIG. 27 is a side elevation view that shows the blowout preventer from FIG. 25 after machining.

Referring to FIG. 27, a blowout preventer body 70 is shown consisting of a first billet 72 and a second billet 74. First billet 72 has been formed as a first portion 76 of body 70, and second billet 74 has been formed as a second portion 78 of body 70. In the description below, it will be understood that billets 72 and 74 may be formed to have the desired characteristics by any suitable process, such as forging, machining, or a combination thereof. In the example shown, first portion 76 is the top portion of body 70, while second portion 78 is the bottom portion of body 70.

Figure 5:
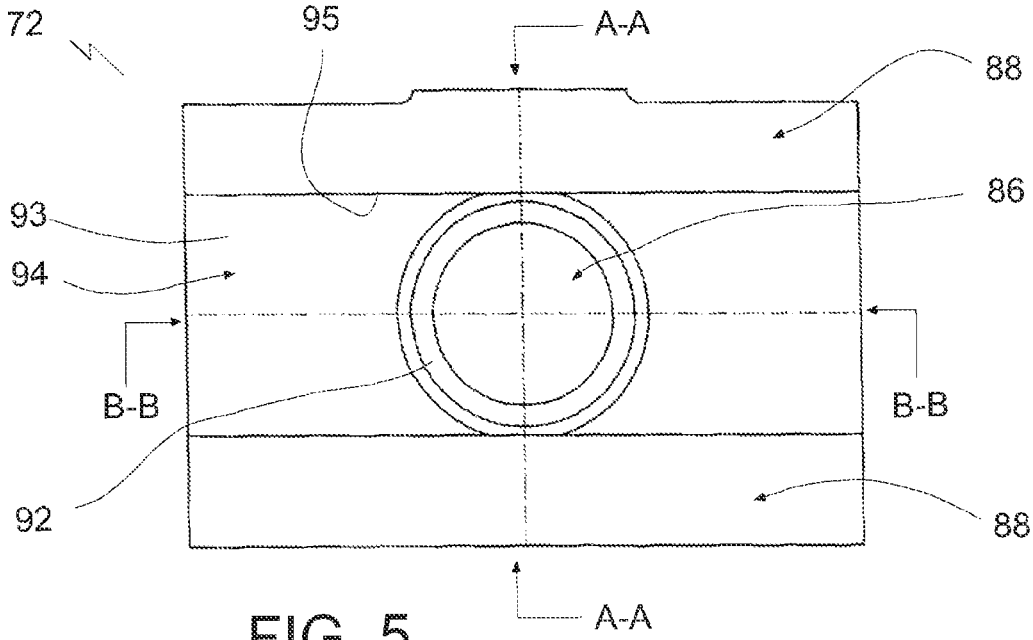
FIG. 5 is a bottom elevation view, in section, of a forged billet that will form a first portion of a blowout preventer.
Figure 6:
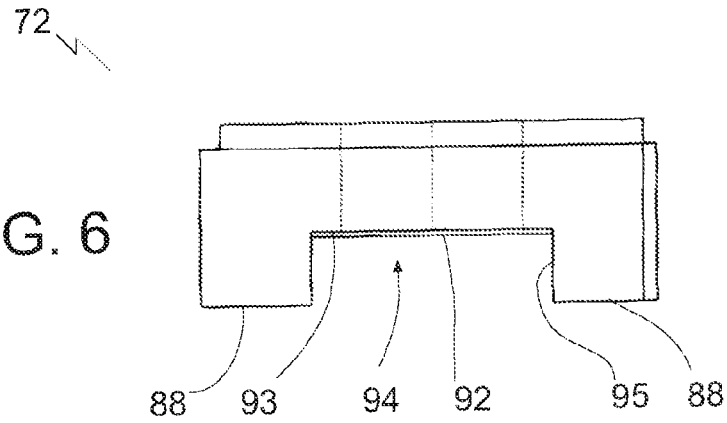
FIG. 6 is a section view of the forged billet from FIG. 5 viewed along the A-A line of FIG. 5.
Figure 7:
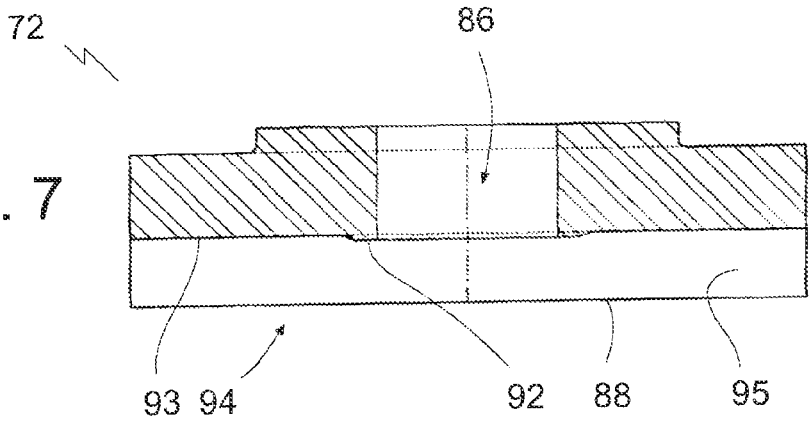
FIG. 7 is a section view of the forged billet from FIG. 5 viewed along the B-B line of FIG. 5.
Figure 8:
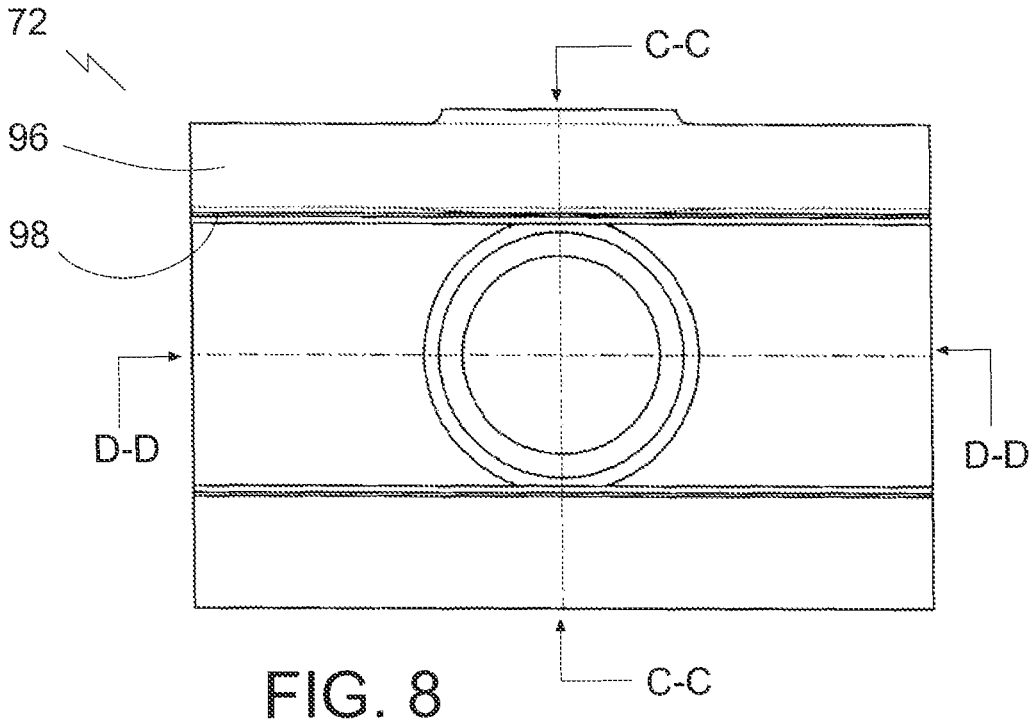
FIG. 8 is a bottom elevation view, in section, of the forged billet from FIG. 5 after machining.
Figure 9:
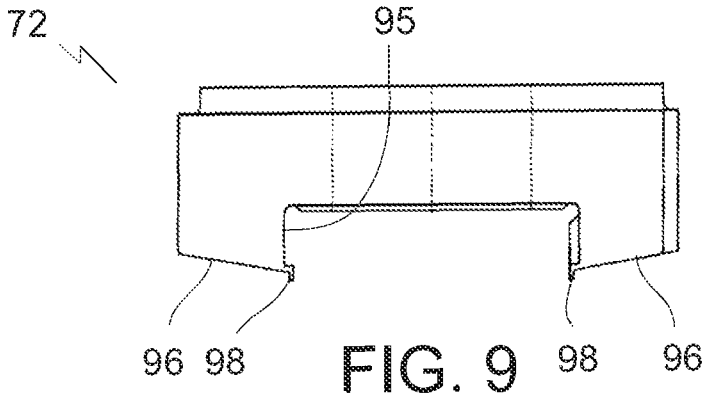
FIG. 9 is a section view of the forged billet from FIG. 8 viewed along the C-C line of FIG. 8.
Figure 10:
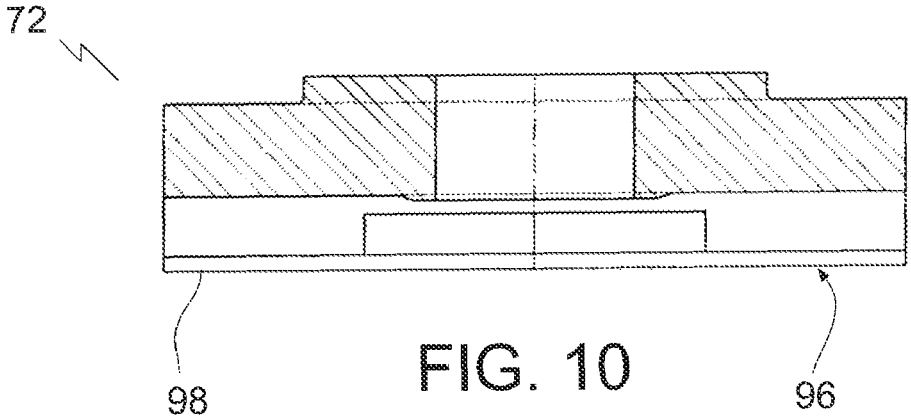
FIG. 10 is a section view of the forged billet from FIG. 8 viewed along the D-D lines of FIG. 8.

Referring to FIGS. 5-7, different views of first billet 72 are shown. Referring to FIG. 5, first billet 72 consists of a pipe passageway 86 and a first surface 88. Pipe passageway 86 may be circular as shown, in order to allow a pipe (not shown) to be passed through or positioned within pipe passageway 86. Referring to FIGS. 5-7, a first gate portion 94 has been formed out of first surface 88, as shown. First gate portion 94 is provided with a seat 92, a base 93 and sidewalls 95. Seat 92 may be provided as part of forged first billet 72, or may be provided as a replaceable part. Referring to FIGS. 8-10, first surface 88 of first billet 72 has been machined to form weld preparation surfaces 96 and contact tips 98.

Figure 11:
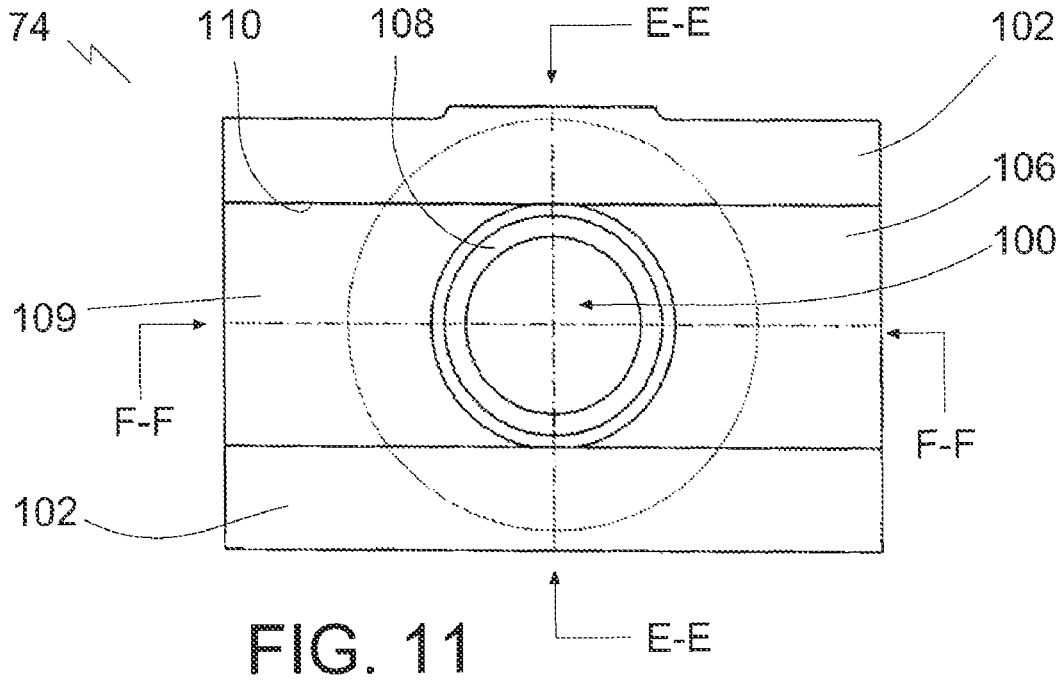
FIG. 11 is a top elevation view, in section, of the forged billet that will form the bottom portion of a blowout preventer.
Figure 12:
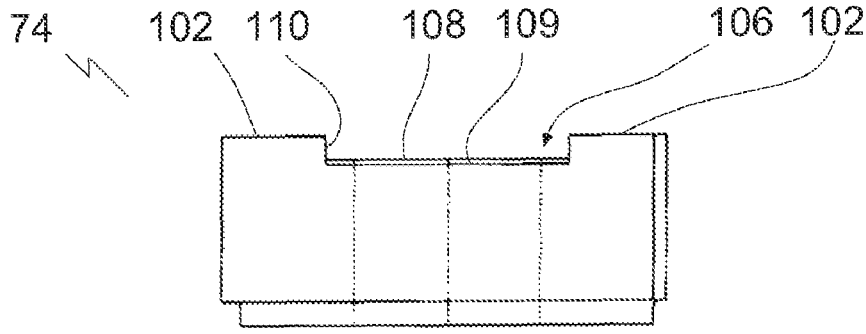
FIG. 12 is a section view of the forged billet from FIG. 11 viewed along the E-E line of FIG. 11.
Figure 13:
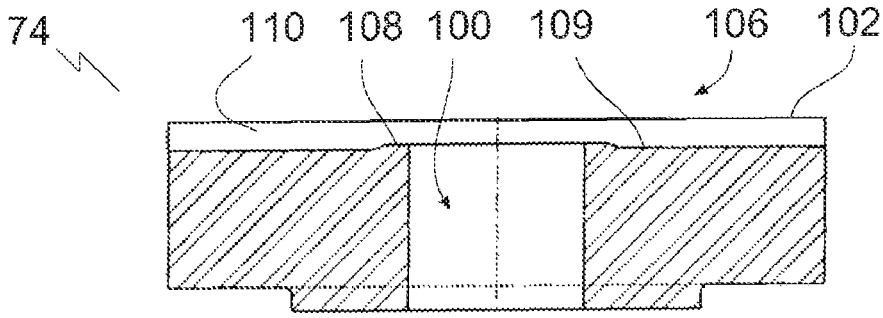
FIG. 13 is a section view of the forged billet from FIG. 11 viewed along the F-F line of FIG. 11.
Figure 14:
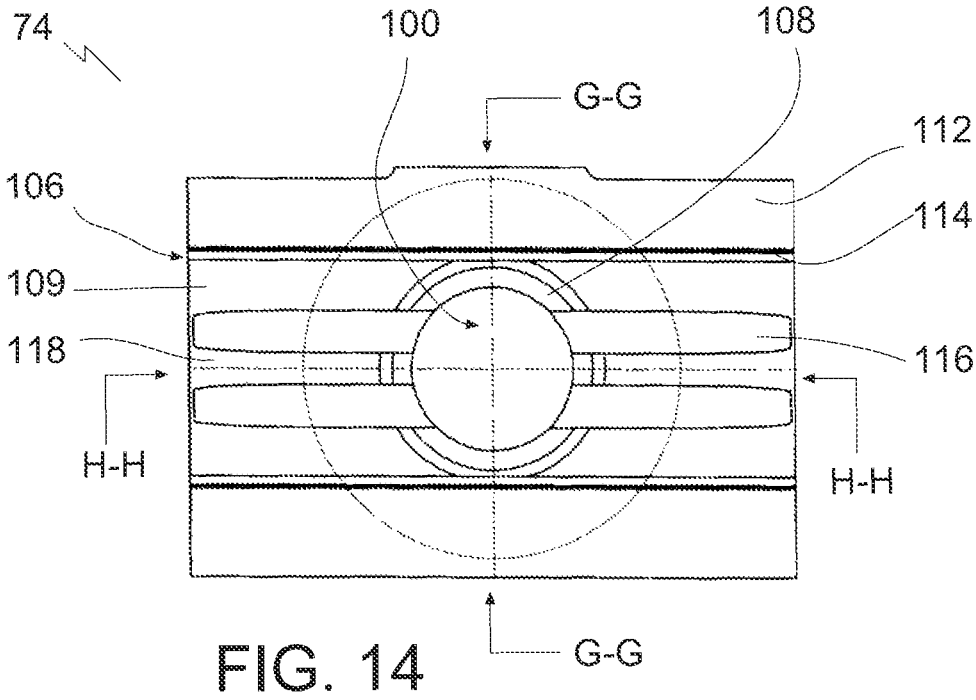
FIG. 14 is a top elevation view, in section, of the forged billet from FIG. 11 after machining.
Figure 15:
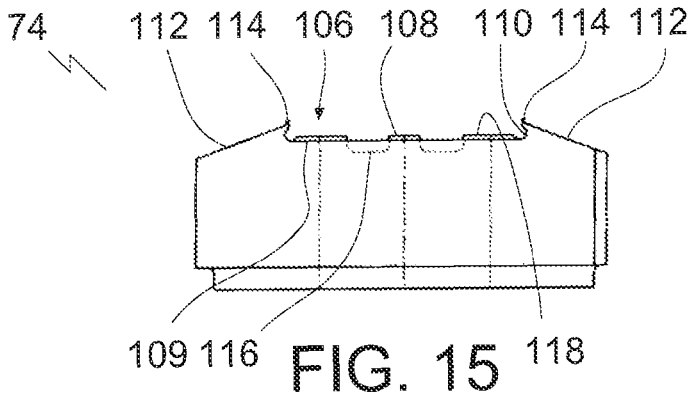
FIG. 15 is a section view of the forged billet from FIG. 14 viewed along the G-G line of FIG. 14.
Figure 16:
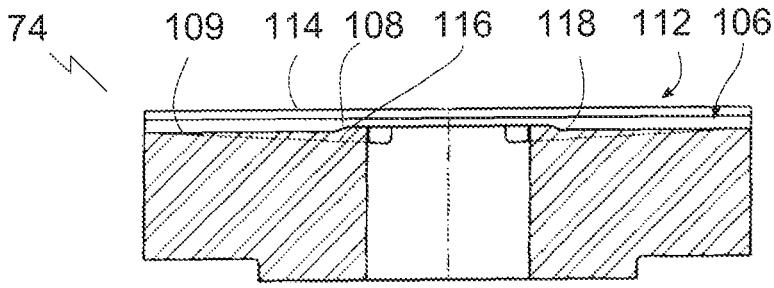
FIG. 16 is a section view of the forged billet from FIG. 14 viewed along the H-H line of FIG. 14.

Referring to FIGS. 11-13, different views of second billet 74 are shown. Referring to FIG. 11, second billet 74 consists of a pipe passageway 100 and a first surface 102. Pipe passageway 100 is shown to be circular, in order to allow a pipe (not shown) to be passed through or positioned within pipe passageway 100. Referring to FIGS. 11-13, a second gate portion 106 has been formed out of first surface 102, as shown. Second gate portion 106 is provided with a seat 108, a base 109, and sidewalls 110. Seat 108 may be provided as part of forged second billet 74, or may be provided as a replaceable part. Referring to FIGS. 14-16, second billet 74 has been further machined to form weld preparation surfaces 112 and contact tips 114 out of first surface 102 and gate grooves 116 out of base surface 109 and seat 108. Gate grooves 116 are provided to allow fluid to flow behind a ram block (not shown) when the ram block is moved to close passageway 100 in the event of a blowout. Gate grooves 116 define skids 118, skids 118 being the material remaining from base 109 and seat 108 after machining. Alternatively, skids 118 may be provided as replaceable parts that can be easily replaced and secured into second billet 74 using conventional methods.

Figure 22:
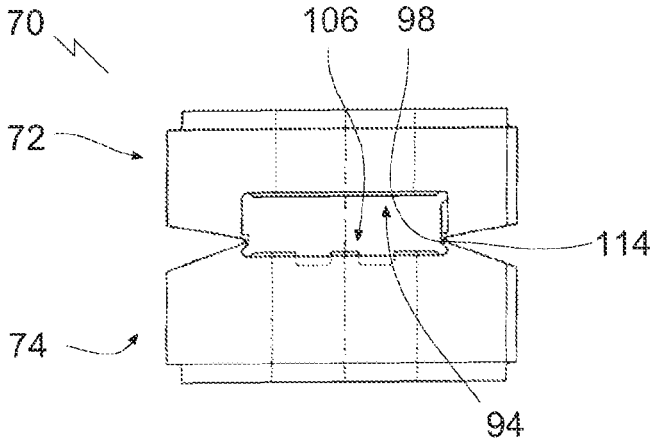
Figure 25:
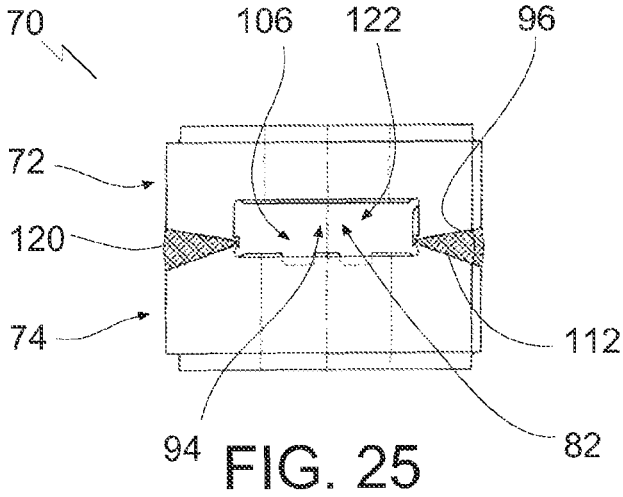
Figure 31:
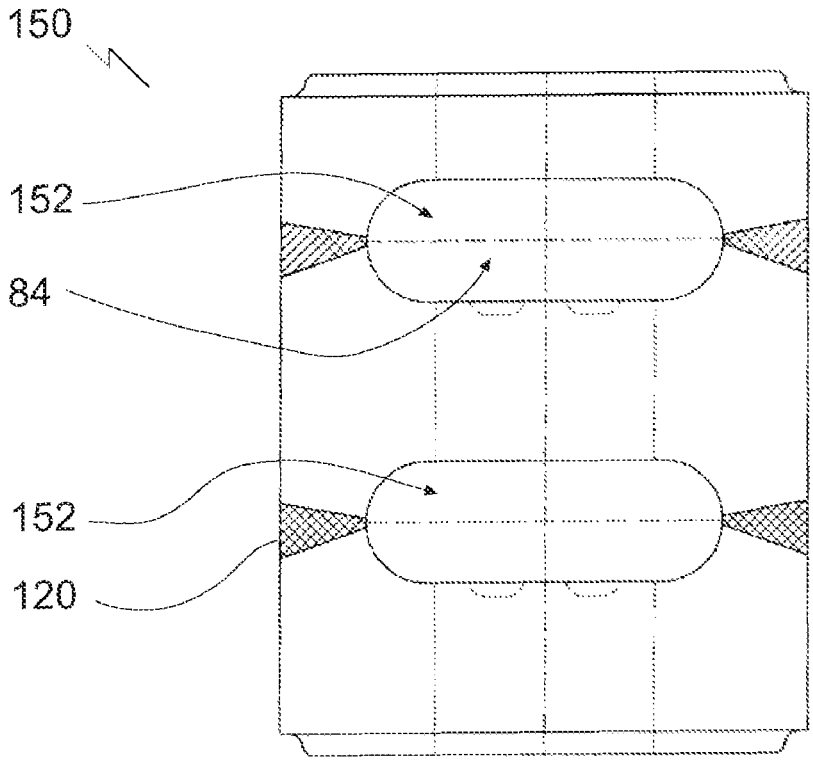
FIGS. 31-32 are side elevation views that show the blowout preventers from FIGS. 29-30, respectively, after machining.
Figure 32:
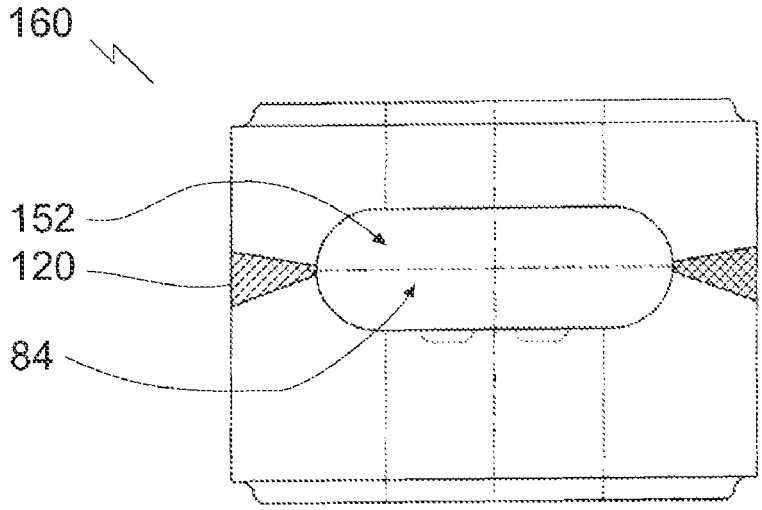
Figure 33:
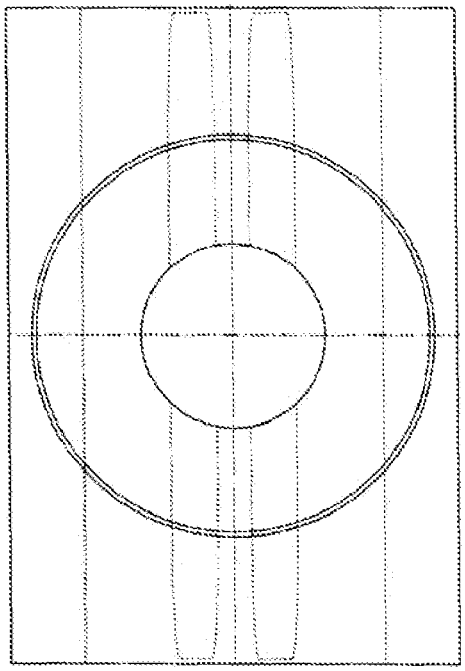
FIG. 33 shows a top elevation view of the blowout preventer from FIG. 32 after machining.

Referring to FIG. 22, first gate portion 94 formed in first surface 88 of first billet 72 is positioned adjacent to second gate portion 106 formed in first surface 102 of second billet 74. Contact tips 98 and 114 are aligned and allow first billet 72 to be positioned on second billet 74. Referring to FIG. 25, first and second billets 72 and 74, respectively, have been welded together to form blowout preventer body 70. The welding of first and second billets 72 and 74, respectively, together is accomplished by forming welds of metal 120 between weld preparation surfaces 96 and 112. The selection of the type of welding used will be influenced by standards created by regulatory organizations for pressure containing equipment, for example a qualified material specific full penetration weld. When first and second billets 72 and 74, respectively, are welded together, first gate portion 94 and second gate portion 106 form a gate cavity 122 of blowout preventer body 70. Gate cavity 122 is designed to hold a ram block, or any other blowout preventing pipe-shearing/sealing devices known in the art. Gate cavity 122 is constructed to have a rectangular cross section 82, although other shapes of cross sections are possible with this method of manufacture. While rectangular ram blocks are described, it will be understood that the cross-section of either the block or gate may have some variance from a rectangle, such as rounded corners, substantially equal sides, projections/depressions, etc. as will be recognized by those familiar with blowout preventers. Furthermore, the techniques described herein can be used to form blowout preventers with different gate shapes other than rectangles. Referring to FIGS. 31 and 32, respectively, blowout preventer bodies 150 and 160, respectively, may be constructed to have a gate cavity 152 that has a semi-circular cross section 84. Cross sections 82 and 84 are both designed to be fitted with appropriately-shaped ram blocks (not shown).

Referring to FIG. 27, blowout preventer body 70 has been machined after welding first and second billets 72 and 74, respectively, together. In the example shown in FIG. 27, contact tips 98 and 114 (shown in FIG. 22), and sidewalls 95 and 110 have been machined down, although other surfaces of body 70 may be machined as well. Body 70 must be machined upon welding, in order to qualify welds 120 as full penetration welds. Machining may be accomplished using machining processes known in the art, such as broaching and shaping, although other methods may be devised.

Figure 17:
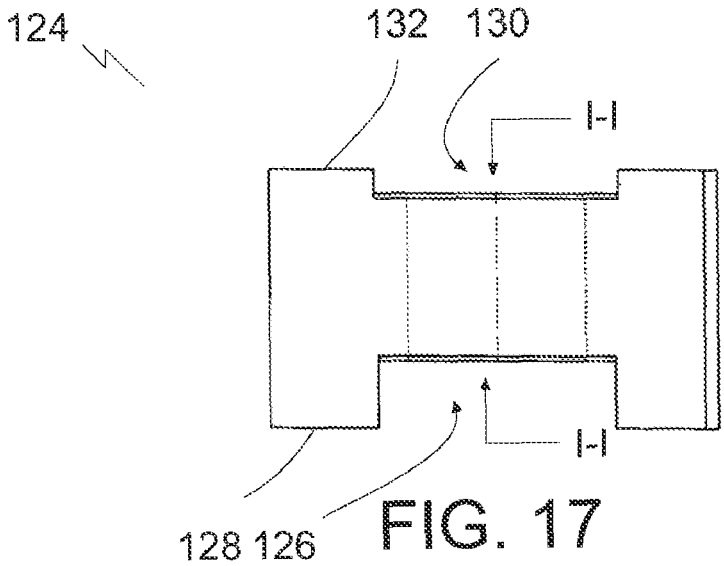
FIG. 17 is a side elevation view, in section, of a forged billet that will form the intermediate portion of a blowout preventer.
Figure 18:
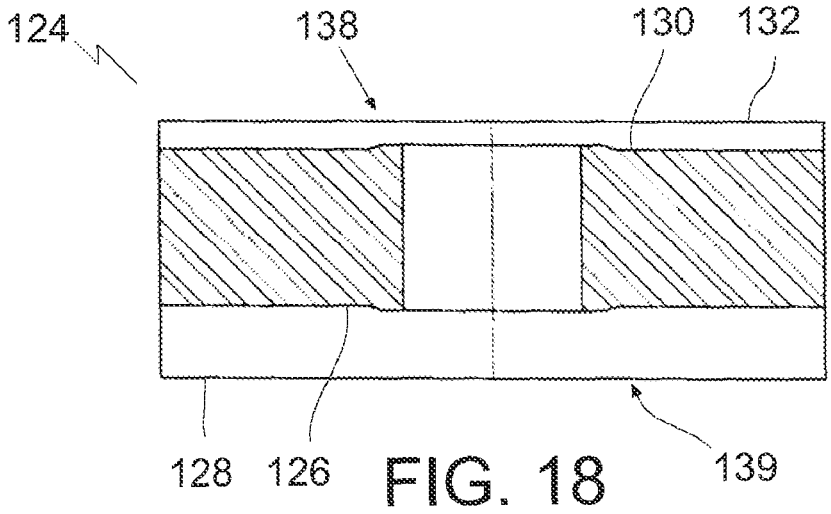
FIG. 18 is a section view of the forged billet from FIG. 17 viewed along the I-I line of FIG. 17.
Figure 19:
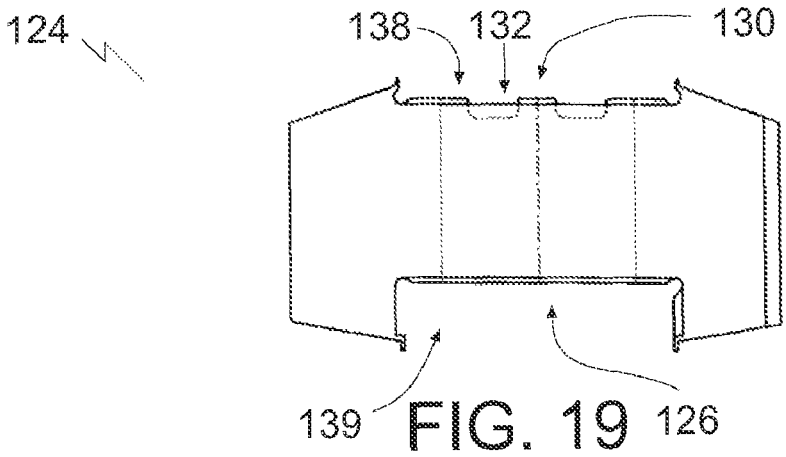
FIG. 19 is a side elevation view, in section, of the forged billet from FIG. 17 after machining.
Figure 20:
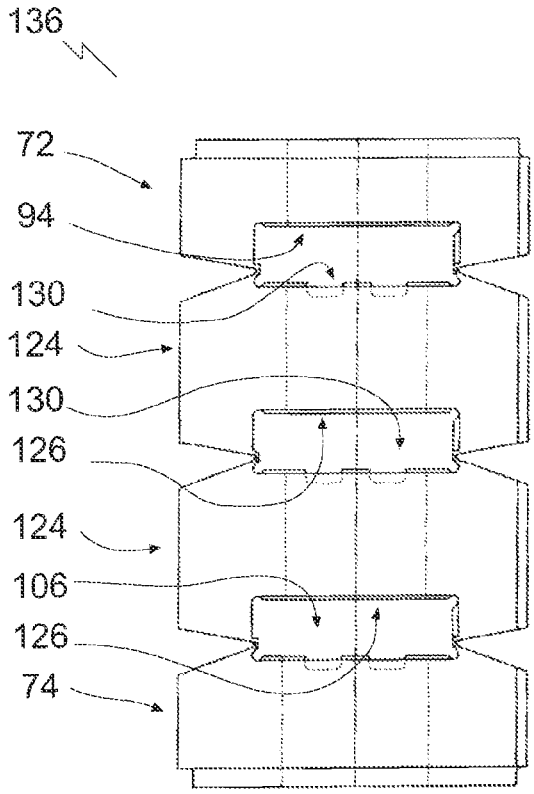
FIGS. 20-22 are side elevation views that show blowout preventers with three, two and one rectangular gate(s), respectively, constructed using the method described for constructing a blowout preventer body.
Figure 21:
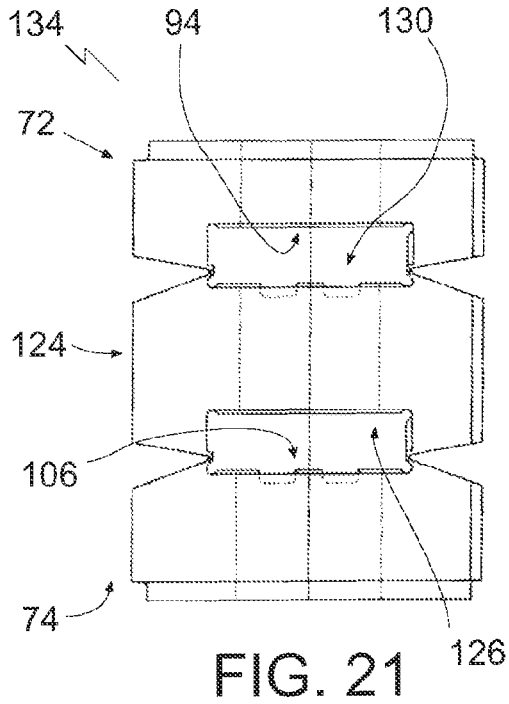

Referring to FIGS. 17-18, an intermediate billet 124 is provided. A first gate portion 126 has been formed out of a first surface 128, first gate portion 126 being formed identical to first gate portion 94 of first billet 72 as shown in FIGS. 6-7. A second gate portion 130 has been formed out of a second surface 132 of intermediate billet 124, second gate portion 130 being formed identical to second gate portion 106 of second billet 74 as shown in FIGS. 12-13. Second surface 132 is positioned parallel to first surface 128. Referring to FIG. 19, first and second gate portions 126 and 130, respectively, have been machined in an identical fashion as first and second gate portions 94 and 106, respectively, have been machined in FIGS. 9 and 15, respectively. Referring to FIG. 21, intermediate billet 124 is positioned between first and second billets 72 and 74, respectively, forming a blowout preventer body 134. First gate portion 126 in first surface 128 of intermediate billet 124 is oriented toward second gate portion 106 in first surface 102 of second billet 74 and second gate portion 130 in second surface 132 of intermediate billet 124 is oriented toward first gate portion 94 in first surface 88 of first billet 72. Referring to FIG. 20, two intermediate billets 124 are positioned in between first and second billets 72 and 74, respectively, in the same orientation as described above for FIG. 21, forming a blowout preventer body 136, that has each one of first gate portions 94 and 126 oriented towards one of second gate portions 106 and 130.

Figure 23:
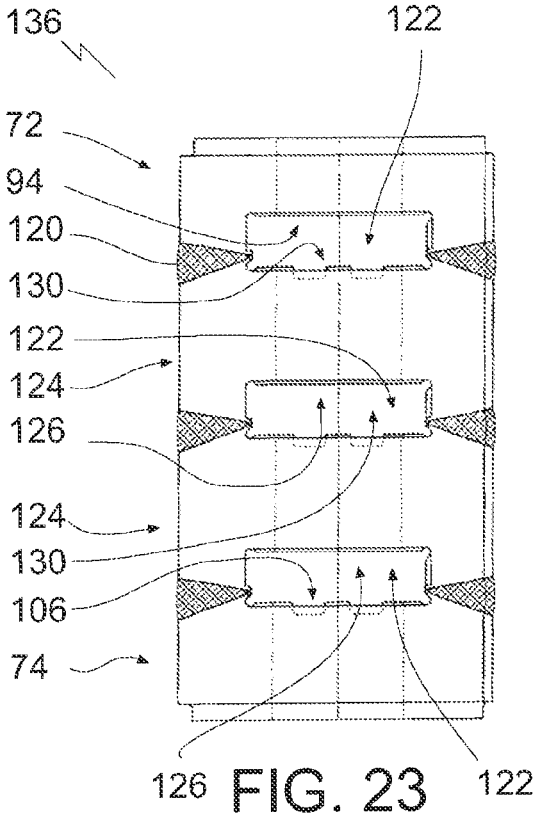
FIGS. 23-25 are side elevation views that show the blowout preventers from FIGS. 20-22, respectively, after welding.
Figure 24:
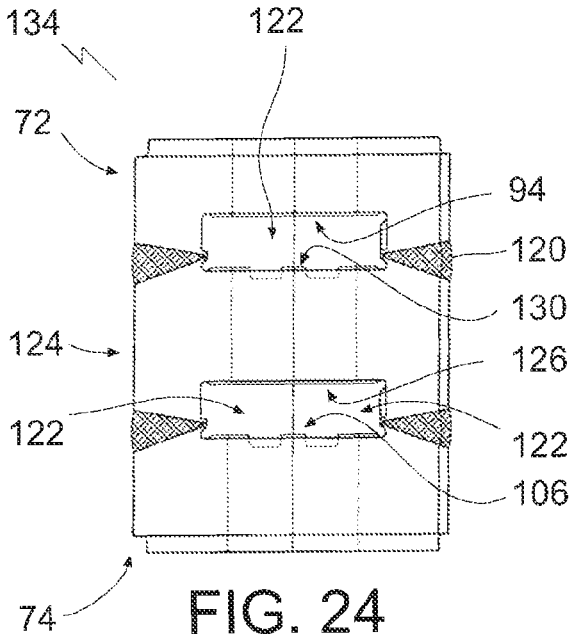

Referring to FIGS. 23-24, intermediate billets 124 from FIGS. 20-21, respectively have been welded together using welds of metal 120. The welding is done in an identical fashion as that described for FIG. 25. In this manner, each combination of one of first gate portions 94 and 126 combined with one of second gate portions 106 and 130 form more than one gate cavity 122 in blowout preventer bodies 134 and 136. It will be understood that blowout preventer bodies 134 and 136 can be machined in a fashion identical to that described for blowout preventer 70 in FIG. 27.

Figure 28:
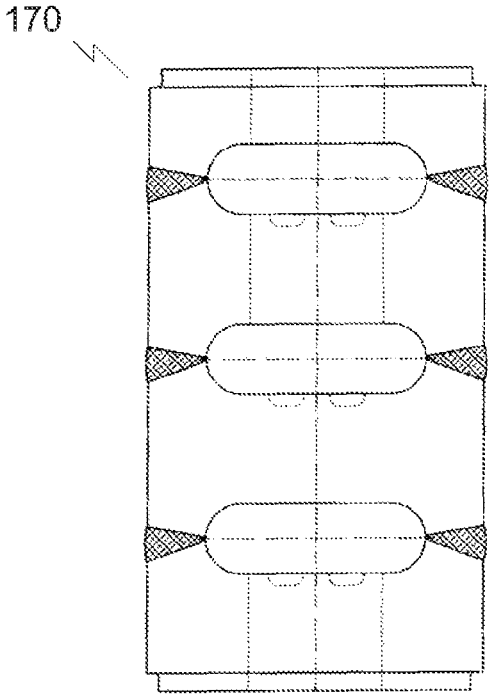
FIGS. 28-30 are side elevation views that show blowout preventers with three, two and one semi-circular gate(s), respectively, constructed using the method described for constructing a blowout preventer body, and after welding.
Figure 29:
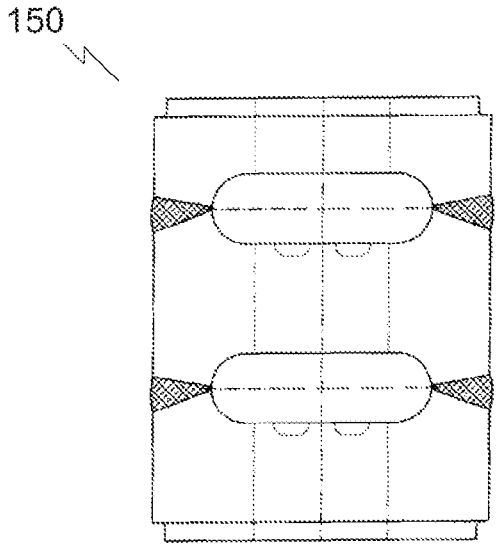
Figure 30:
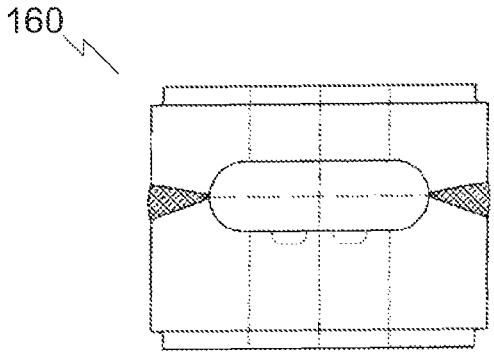

Referring to FIG. 32, blowout preventer body 160 with a gate cavity 152 with semi-circular cross section 84 is shown after full penetration welding has been completed. Referring to FIG. 30, blowout preventer body 160 is shown before the final machining step to complete the full penetration weld. Referring to FIG. 31, blowout preventer body 150 with two of gate cavities 152 with semi-circular cross sections 84 are shown after full penetration welding has been completed. It should be understood that any number of gate cavities 152, 122 may be constructed on any of the above described embodiments. Referring to FIG. 29, blowout preventer body 150 is shown before the final machining step to complete the full penetration weld. Referring to FIG. 28, a blowout preventer body 170 is shown before the final machining step to complete the full penetration weld.

Figure 34:
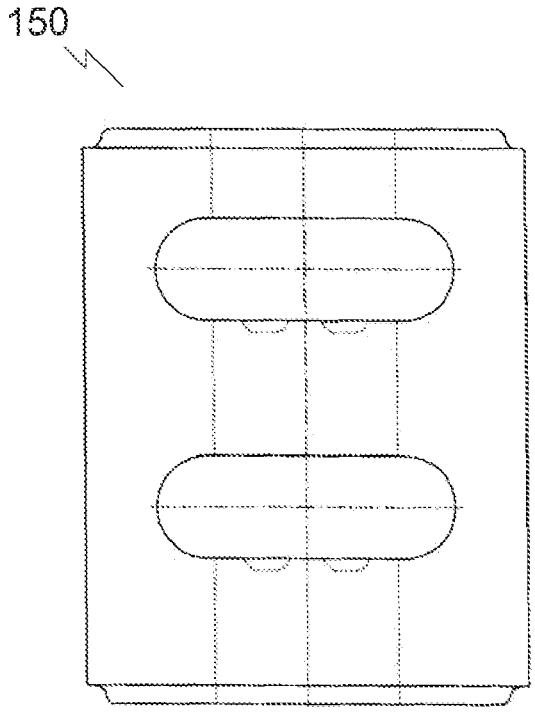
FIGS. 34-35 are side elevation views that show the blowout preventers from FIGS. 31-32, respectively, after machining.
Figure 35:
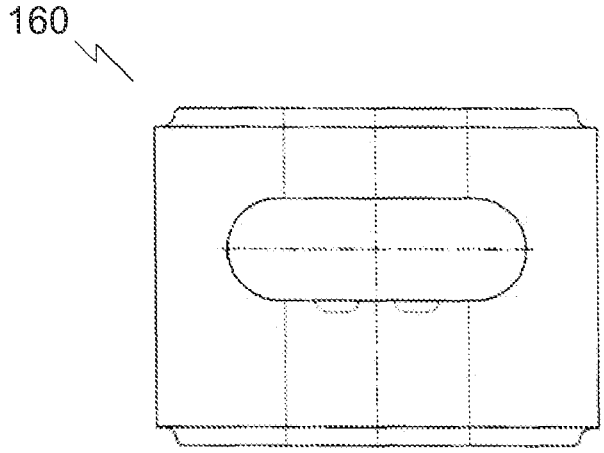

Referring to FIGS. 34 and 35, blowout preventer bodies 150 and 160 are shown in a completed state. Bodies 150 and 160 may be machined and heat treated or otherwise treated to relieve the stresses that may have been created during welding if necessary.

Figure 36:
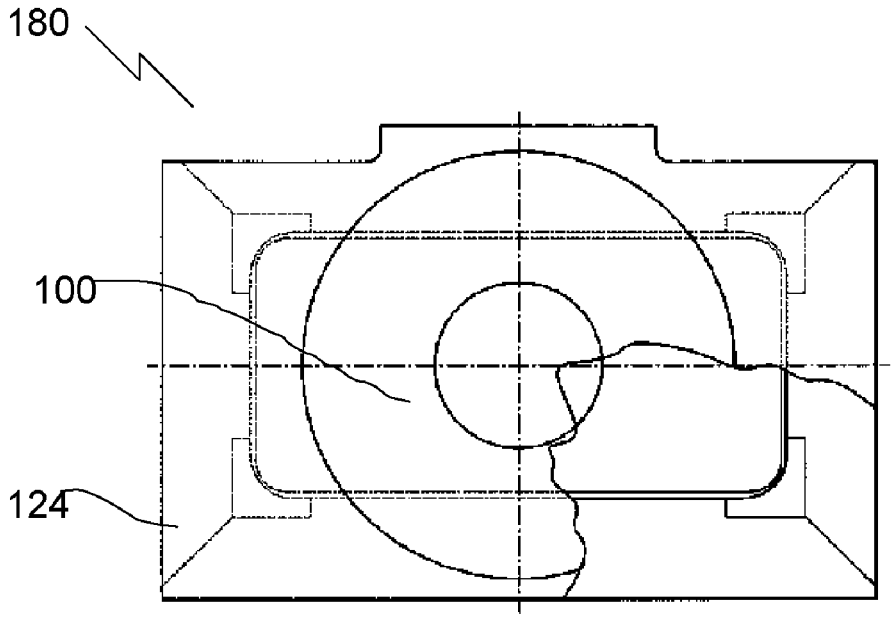
FIG. 36 is a top plan view in section of a blowout preventer body requiring four sides welded.
Figure 37:
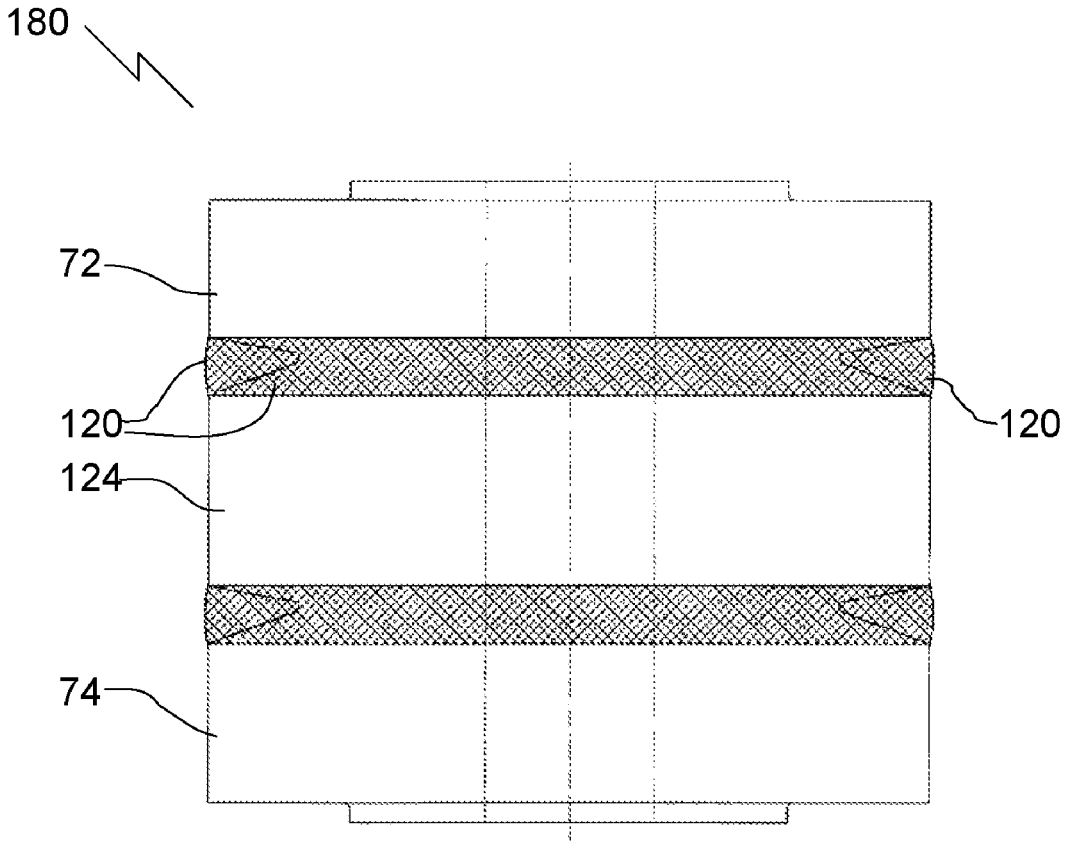
FIG. 37 is a side elevation view of a blowout preventer body requiring four sides welded.

It will be understood that the steps described herein are applicable to blowout preventers that only require two sides to be welded, which is shown in the embodiments described above, as well as blow out preventers that require all four sides to be welded with welds 120, as shown in FIGS. 36 and 37. Once properly processed, normal machining routines may be used to finish the blowout preventer 180 as required.

The term "billet" commonly refers to a blank steel product that has been prepared for further processing, such as forging and machining. In this application, the term is used to refer to any product that has been sufficiently processed to be used in the method described herein.

Operation:

Referring to FIG. 6, first billet 72 is provided, first billet 72 having had first gate portion 94 formed in first surface 88. As stated above, forming may include processes such as forging, machining, or a combination thereof. Referring to FIG. 12, second billet 74 is provided, second billet 74 having had second gate portion 106 formed in first surface 102. Both of first and second billets 72 and 74, respectively, are forged using hot-working methods. A clean billet (not shown) is initially provided, the clean billet being free from sand and slag inclusions inherent in steel cast processes. The billet is then hot worked into the desired shape by pressing and hammering with shaped dies. The hot working of the billet improves the material properties by producing a finer flowing grain structure as the material is formed into its shape. The result, after appropriate heat-treating processes if necessary, is a superior material, free from defects.

Referring to FIGS. 9 and 10, respectively, first and second billets 72 and 74 are machined to prepare each for welding together to form blowout preventer 70 (shown in FIG. 22). Referring to FIG. 9, machining processes form weld preparation surfaces 96, contact tips 98, and shape sidewalls 95 into their desired shape. Referring to FIG. 15, machining processes form weld preparation surfaces 112, contact tips 114, gate grooves 116, and shape sidewalls 110 into their desired shape. Alternatively, replaceable skids 118 may be added in place of the remaining base 109 material surrounding gate grooves 116. Because base 109 is prone to wear, it is desirable to afford a user the option to replace skids 118 if they wear out.

Referring to FIGS. 17 and 19, if more than one gate cavity 122 (shown in FIG. 22) is required for blowout preventer 70, one or more intermediate billets 124 may be created and used. Intermediate billet 124 may be forged and machined in a fashion similar to that used above for forming and machining first and second gate portions 94 and 106, respectively, of first and second billets 72 and 74 (shown in FIG. 22). First gate portion 126 may be forged and machined from first surface 128, while second gate potion 130 may be forged and machined from second surface 132. First and second gate potions 126 and 130, respectively, are completed to have a top profile 138 and a bottom profile 139 identical with first and second gate portions 94 and 106, respectively.

Figure 26:
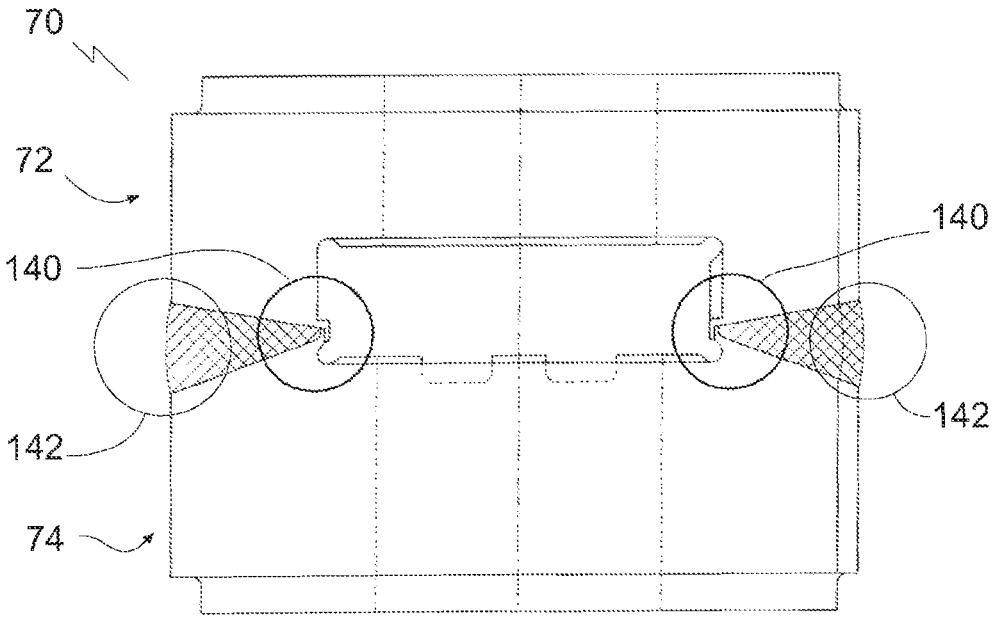
FIG. 26 is a side elevation view that shows the areas of the blowout preventer from FIG. 25 to be machined after welding.

Referring to FIG. 22, for blowout preventer 70, only one gate cavity 122 is required. First billet 72 is first assembled with second billet 74 as shown, so that contact tips 98 and 114 hold first and second billet 72 together in place for welding. First and second gate portions 94 and 106, respectively, are now oriented together to form gate cavity 122. Referring to FIG. 25, welds of metal 120 are then placed between weld preparation surfaces 96 and 112, such that first and second billets 72 and 74, respectively, are welded together. After appropriate machining and stress relieving, such as by heat treating blowout preventer 70, blowout preventer 70 is allowed to cool, and further machining of blowout preventer 70 can take place. Referring to FIG. 26, positions 140 indicate the areas of blowout preventer 70 that requires further machining in the next step, and positions 142 indicate the areas that are optional for further machining. Referring to FIG. 27, contact tips 98 and 114 (shown in FIG. 25), are machined down to complete the required full penetration weld, and optional sidewalls 95 and 110 machined down.

Referring to FIG. 21, if an additional gate cavity 122 is required for the completed product, then intermediate billet 124 is prepared and assembled with first and second billets 72 and 74, respectively as shown. First gate portion 94 of first billet 72 is oriented with second gate portion 130 of intermediate billet 124 to define gate cavity 122. Second gate portion 106 of second billet 74 is oriented with first gate portion 126 of intermediate billet 124 to define gate cavity 122. If still more gate cavities 122 are required, then additional intermediate billets 124 may be assembled in between first and second billets 72 and 74, respectively, such that they are oriented in a similar fashion as described above. Blowout preventer 134 may then be completed by welding, appropriate stress relieving and machining, as described above for blowout preventer 70.

Referring to FIG. 32, the above described process can be modified to create blowout preventer 160 having gate cavity 152 that has semi-circular cross section 84. The product can be completed using the above-described process.

Once blowout preventer 70 is completed, body 70 is free from defects and far superior to the steel cast body blowout preventers used in the prior art. Alterations can be made to any of the above described embodiments, such as addition of threaded stud holes, hydraulic fluid flow holes, and outlet additions, to name a few examples.

The weld configurations shown in this document are only one way used to achieve the fabrication of the above-described blowout preventer bodies. The welds may be of different configurations and locations to arrive at the same net result. It should be understood that one skilled in the art would be able to adjust the weld positions and shapes, as the process could essentially net the same result.

Another distinct advantage to the method described here is the access to the internal rectangular cavity prior to welding the pieces together. In this component stage, additional machining may be done to prepare the body to accept replaceable parts such as seats and skids, which typically wear with usage. Internal machining processes are costly, difficult and in some cases, impossible when the body is formed in one piece. In the component stage however, all machining processes are viable due to access to all surfaces.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope defined in the Claims.

What is claimed is:

1. A method of manufacturing a blowout preventer body, comprising the steps of:

providing more than one billet;

forming a first billet to form a first portion of the blowout preventer body;

forming a second billet to form a second portion of the blowout preventer body; and welding the billets to form the blowout preventer body; wherein forming the first billet comprises forming a first gate portion in a first surface of the first billet;

forming the second billet comprises forming a second gate portion in a first surface of the second billet; and welding the billets comprises positioning the first surface of the first billet adjacent to the second surface of the second billet such that the first gate portion and the second gate portion forms a gate of the blowout preventer body; wherein the blowout preventer body has more than one gate, further comprising the step of:

forming a first gate portion in a first surface of at least one intermediate billet, and forming a second gate portion in a second surface of the at least one intermediate billet, the second surface of the intermediate billet being parallel to the first surface of the intermediate billet; and wherein the step of welding the billets comprises positioning the at least one intermediate billet between the first and the second billet, such that the first surface of each intermediate billet is oriented toward the first surface of the second billet and the second surface of each intermediate billet is oriented toward the first surface of the first billet such that the first gate portions and the second gate portions form more than one gate of the blowout preventer body.

2. The method of claim 1, wherein the gate has a rectangular cross-section.

3. The method of claim 1, wherein welding the billets comprises welding the billets using a full penetration weld.

4. The method of claim 1, wherein welding the billets comprises welding one of two sides of the billets and four sides of the billets.

5. The method of claim 1, wherein forming a first billet and forming a second billet comprises forging, machining, or forging and machining.

6. The method of claim 1, further comprising the step of stress relieving the blowout preventer body.

7. A method of manufacturing a blowout preventer body, comprising the steps of:

providing a first billet, a second billet, and at least one intermediate billet;

forming the first billet to form a first portion of the blowout preventer body, the first portion comprising a first gate portion in a first surface of the first billet;

forming the second billet to form a second portion of the blowout preventer body, the second portion comprising a second gate portion in a first surface of the second billet;

forming a first gate portion in a first surface of the at least one intermediate billet, and forming a second gate portion in a second surface of the at least one intermediate billet, the second surface being parallel to the first surface;

positioning the at least one intermediate billet between the first billet and the second billet, such that the first surface of each intermediate billet is oriented toward the first surface of the second billet and the second surface of each intermediate billet is oriented toward the first surface of the first billet such that the first gate portions and the second gate portions form more than one gate of the blowout preventer body; and welding the billets to form the blowout preventer body.

8. The method of claim 7, wherein each gate has a rectangular cross-section.

9. The method of claim 7, wherein welding the billets comprises welding the billets using a full penetration weld.

10. The method of claim 7, wherein welding the billets comprises welding one of two sides of the billets and four sides of the billets.

11. The method of claim 7, wherein forming each billet comprises forging, machining, or combination thereof.

12. The method of claim 7, further comprising the step of stress relieving the blowout preventer body.

* * * * *